US008578623B1

(12) United States Patent
Anderson et al.

(10) Patent No.: US 8,578,623 B1
(45) Date of Patent: Nov. 12, 2013

(54) HAIR DRYER ATTACHMENT

(75) Inventors: Shekinah Anderson, Atlanta, GA (US); Tamika Harris, Jonesboro, GA (US)

(73) Assignee: SheTiny, LLC, Jonesboro, GA (US)

( * ) Notice: Subject to any disclaimer, the term of this patent is extended or adjusted under 35 U.S.C. 154(b) by 0 days.

(21) Appl. No.: 13/492,200

(22) Filed: Jun. 8, 2012

(51) Int. Cl.
*A45D 20/12* (2006.01)
*A45D 20/18* (2006.01)

(52) U.S. Cl.
USPC ..... 34/98; 34/96; 34/97; 34/99

(58) Field of Classification Search
USPC ..... 34/283, 96–99, 101; 132/271, 212, 284, 132/272, 119.1, 269
See application file for complete search history.

(56) References Cited

U.S. PATENT DOCUMENTS

| | | | | | |
|---|---|---|---|---|---|
| 3,791,391 | A * | 2/1974 | Prince et al. | ..... | 132/261 |
| 3,992,785 | A * | 11/1976 | McCachren | ..... | 34/99 |
| 4,121,353 | A * | 10/1978 | Baumgartner et al. | ..... | 34/99 |
| 4,692,594 | A | 9/1987 | Martin | | |
| 4,809,444 | A | 3/1989 | Henderson et al. | | |
| 5,271,160 | A | 12/1993 | Greiner et al. | | |
| 5,526,578 | A | 6/1996 | Iyer | | |
| 6,457,254 | B2 * | 10/2002 | Sahm | ..... | 34/96 |

* cited by examiner

*Primary Examiner* — Kenneth Rinehart
*Assistant Examiner* — John McCormack
(74) *Attorney, Agent, or Firm* — Merchant & Gould

(57) ABSTRACT

Embodiments are provided for a hair dryer attachment for accelerating hair drying time. The hair dryer attachment includes a housing and multiple flexible conduits. The housing may include an interior surface and an exterior surface. The interior surface may define an interior volume having a size sufficient to cover a substantial portion of a person's head. The interior surface and the exterior surface may define multiple passages. The multiple flexible conduits may each include an inlet and an exit. The inlet of each of the conduits may be in fluid communication with one or more of the multiple passages.

4 Claims, 5 Drawing Sheets

HAIR DRYER ATTACHMENT

FIELD OF DISCLOSURE

The current applications relates to hair drying. More specifically, the current applications relates to an apparatus to more uniformly dry hair and reduce drying time.

BACKGROUND

Currently drying hair can be require a lot of time. After a person has his or her hair styled, they may have to sit under a drying hood for times approaching three hours. During this time, heat may be applied in an uneven fashion. This uneven application of heat can damage the hair. In addition, different types of hair (e.g., weaves, sew-ins, wigs, natural long hair, "roller set") may have different drying times, which may be substantial. For example, a person with natural long hair may have to sit under a conventional dryer for between 2-3 hours.

SUMMARY

This summary is provided to introduce a selection of concepts in a simplified form that are further described below in the Detailed Description. This summary is not intended to identify key features or essential features of the claimed subject matter, nor is it intended as an aid in determining the scope of the claimed subject matter.

Embodiments for a hair dryer attachment for accelerating hair drying time are provided. The hair dryer attachment may include a housing and multiple flexible conduits. The housing may include an interior surface and an exterior surface. The interior surface may define an interior volume having a size sufficient to cover a substantial portion of a person's head. The interior surface and the exterior surface may define multiple passages. The multiple passages may be in fluid communication with a hair dryer hood and positioned at least over the top of a person's head. The multiple flexible conduits may each include an inlet and one or more exits. The inlet of each of the conduits may be in fluid communication with one or more of the multiple passages.

These and other features and advantages will be apparent from a reading of the following detailed description and a review of the associated drawings. It is to be understood that both the foregoing general description and the following detailed description are illustrative only and are not restrictive of the invention as claimed.

BRIEF DESCRIPTION OF THE FIGURES

Non-limiting and non-exhaustive embodiments are described with reference to the following figures, wherein like reference numerals refer to like parts throughout the various views unless otherwise specified.

DETAILED DESCRIPTION

Various embodiments are described more fully below with reference to the accompanying drawings, which form a part hereof, and which show specific embodiments of the invention. However, embodiments may be implemented in many different forms and should not be construed as limited to the embodiments set forth herein, rather, these embodiments are provided so that this disclosure will be thorough and complete, and will fully convey the scope of the invention to those skilled in the art. Therefore, the following detailed description is not to be taken in a limiting sense.

The present application discloses an attachment that may be used to help accelerate a hair drying process. The attachment may be attached to stationary hood or "bonnet" hair dryers which may be typically used in a hair salon or purchased for home use. The attachment may include a concaved housing that may have attached thereto multiple conduits. The conduits may have an opening at only one end and may further have multiple openings located along tone or more conduit sidewalls. The conduits may be inserted directly into portions of a person's hair and may circulate warm air between various strands of hair as opposed to just over the exterior of a person's hair, in order to accelerate drying time. In addition, the conduits may be flexible to allow the person to move his or her head without dislodging the conduits.

Figure 1:
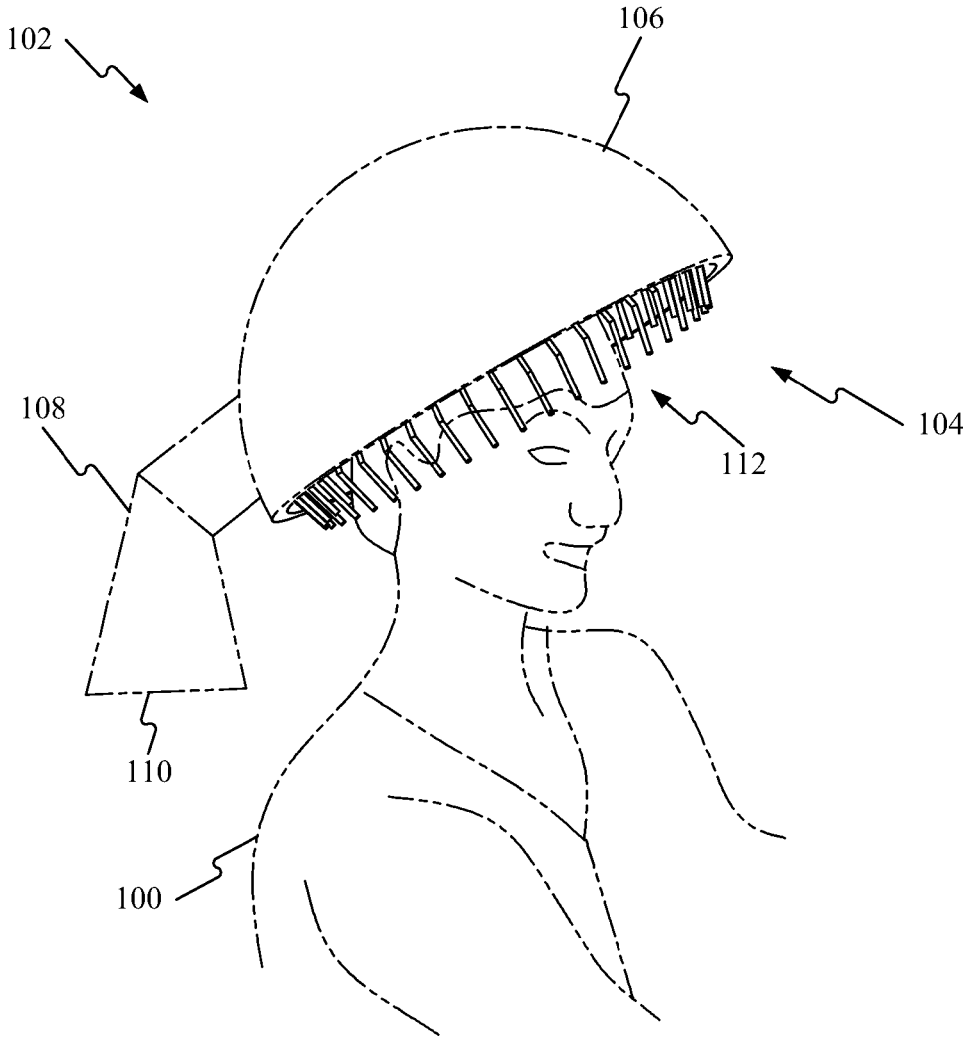
FIG. 1 shows a hair dryer incorporating a hair dryer attachment, in accordance with an embodiment.

Turning now to the figures, FIG. 1 shows a person 100 sitting under a hair drying 102 with an attachment 104. The hair dryer may include a hood 106 that may be connected to a duct 108. The duct may include an inlet 110 that may be in fluid communication with a heating element (not shown). During use, a fan (not shown) may force air across the heating element and through duct the 108. The duct 108 may direct the now heated air into the hood 106. Once inside the hood 106, a portion of the heated air may be forced into attachment 104 and into conduits 112. A portion of the now heated air may also circulate between the attachment 104 and the person's hair.

Figure 2A:
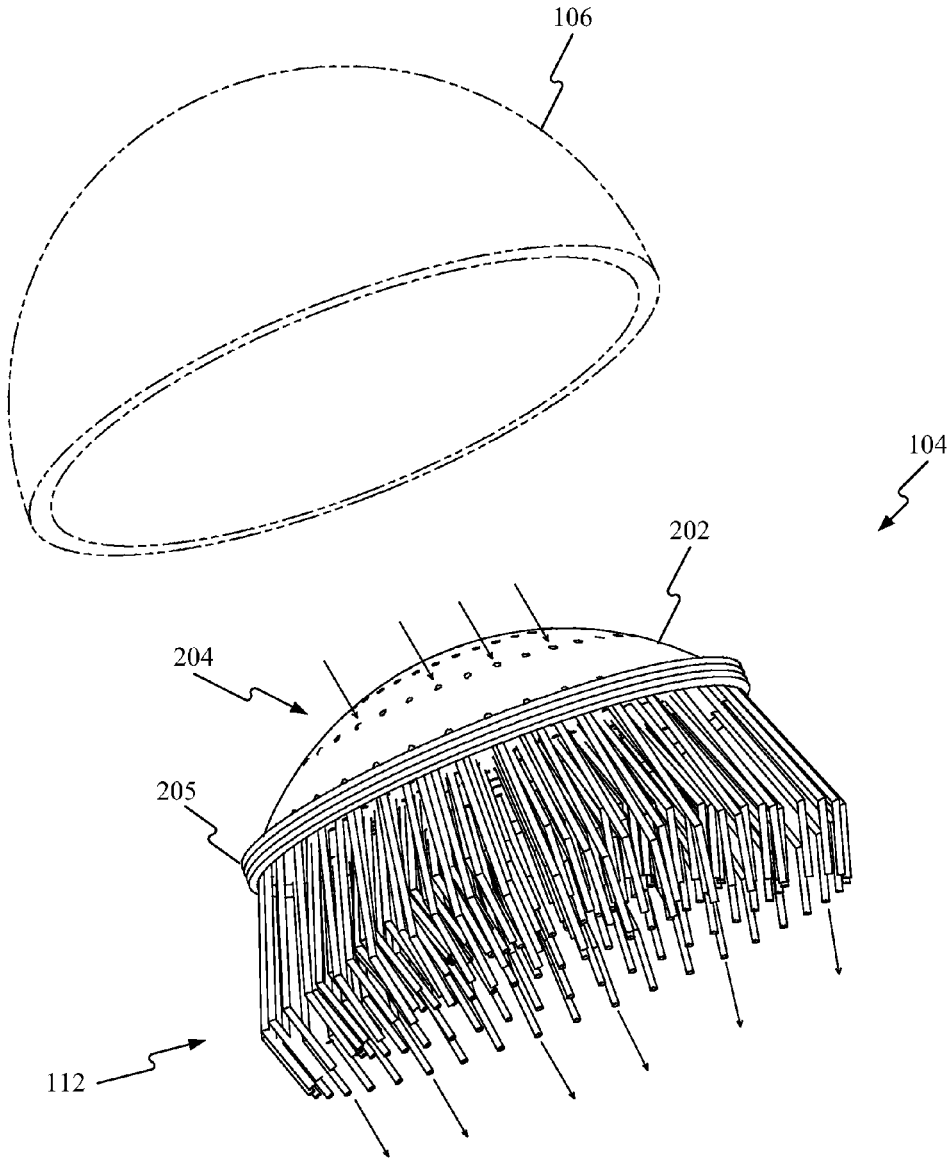
FIG. 2A shows an exploded assembly of a hair dryer hood and the hair dryer attachment, in accordance with an embodiment.
Figure 2B:
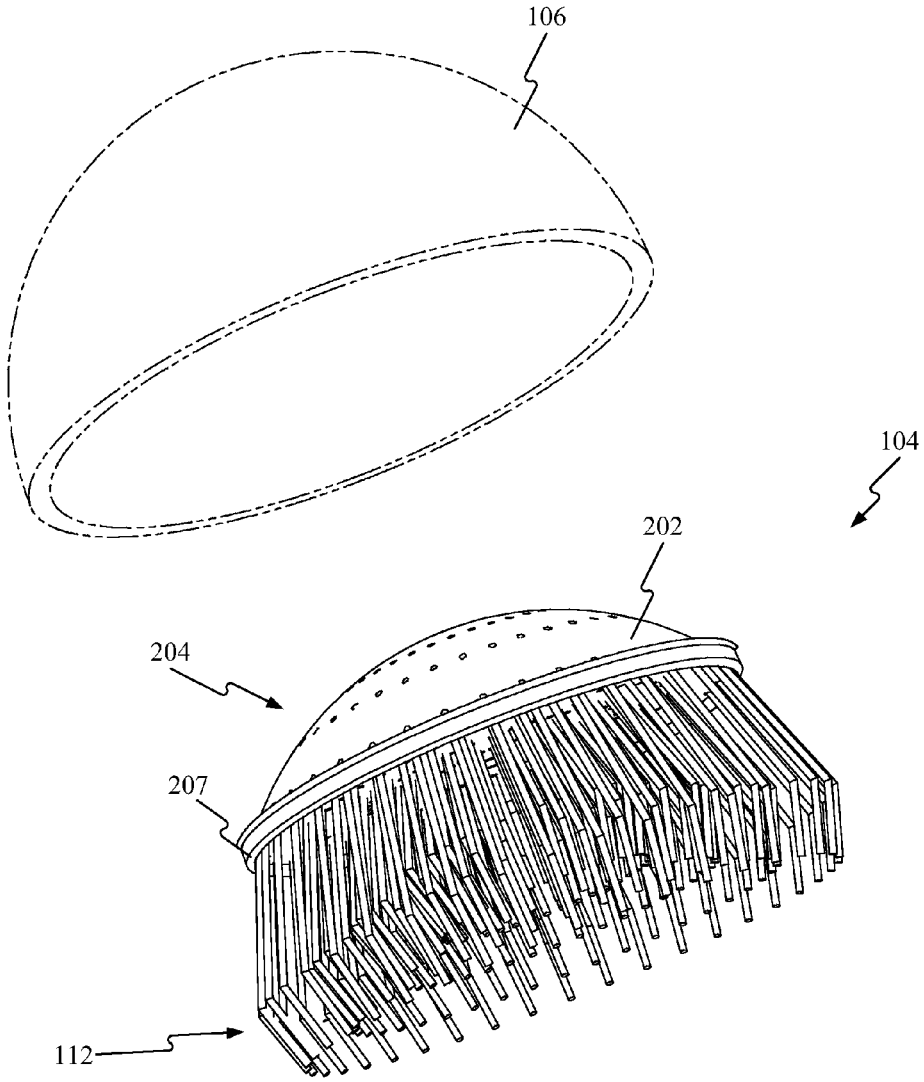
FIG. 2B shows an exploded assembly of a hair dryer hood and the hair dryer attachment, in accordance with an embodiment.

FIGS. 2A and 2B show an exploded assembly of the hair dryer hood 106 and the attachment 104. As shown in FIG. 2A, the attachment 104 may include a housing 202. The housing 202 may include multiple passages (i.e., holes) 204 that may allow a portion of airflow to flow into a concave portion of the housing 202. The airflow may pass through the passages and into the conduits 112.

The housing 202 may have a concaved shape and include an interior surface. The conduits 112 may be attached to the interior surface. The interior surface may be concave and may define an interior volume. The interior volume may be sized to sufficiently cover a substantial portion of a person's head. Covering a substantial portion of a person's head may include covering over half of the person's hair.

The housing 202 may further include a "threaded" rim 205. It should be appreciated that in this configuration, and in combination with a compatible hair dryer hood, the attachment 104 may be easily screwed into the hood 106 for use prior to hair drying. It should be understood that the rim 205 may be configured for attachment to the hood 106 such that a substantial portion of the housing 202 is seated inside of the hood 106.

FIG. 2B shows many of the features described above with respect to FIG. 2A including the attachment 104, the housing 202, the passages 204 and the conduits 112. FIG. 2B also shows a rim 207 which is part of the housing 202. In accordance with an embodiment, the rim 207 may have a slightly smaller diameter than the diameter of the hood 106, thereby allowing the housing 202 to snap into a standard hair dryer for use prior to hair drying. It should be understood that the rim 207 may be configured for attachment to the hood 106 such that a substantial portion of the housing 202 is seated inside of the hood 106.

Figure 3A:
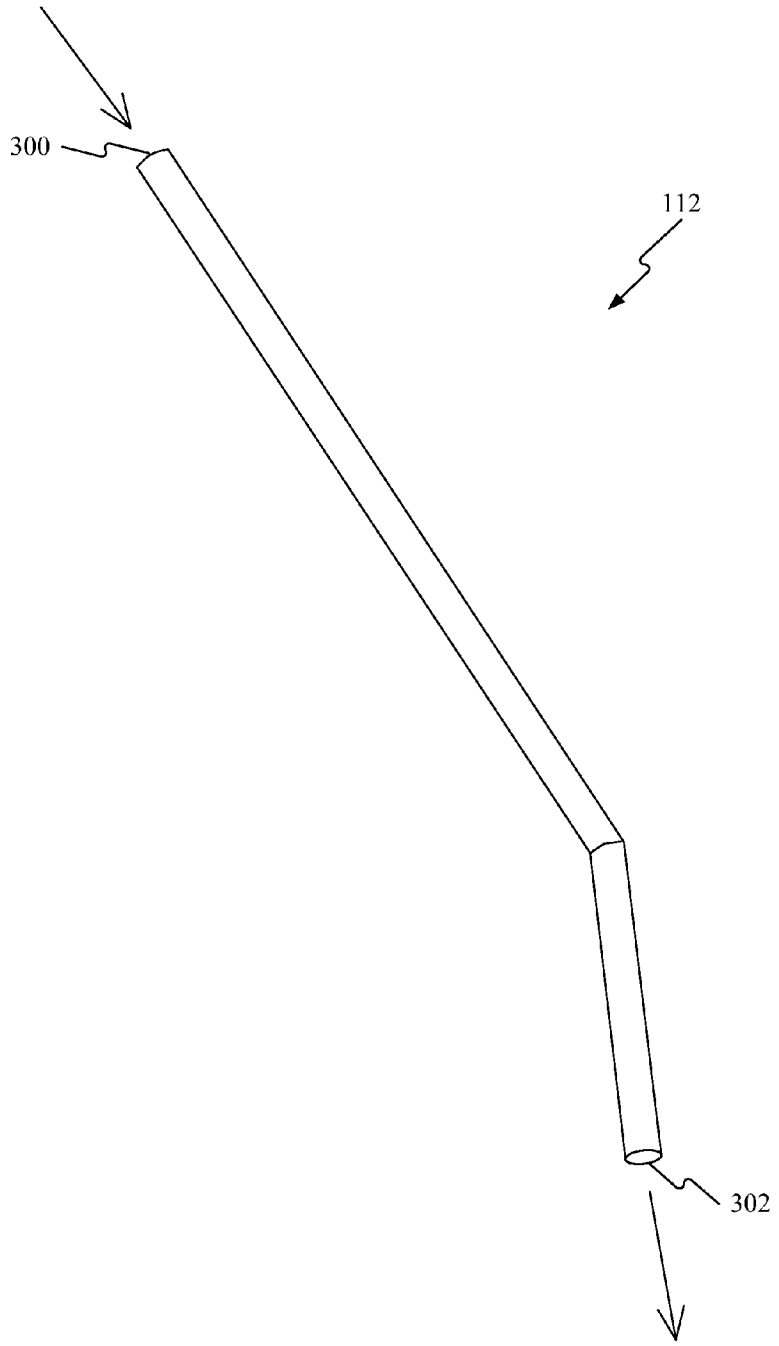
FIG. 3A shows a conduit which may be utilized in the hair dryer attachment, in accordance with an embodiment.
Figure 3B:
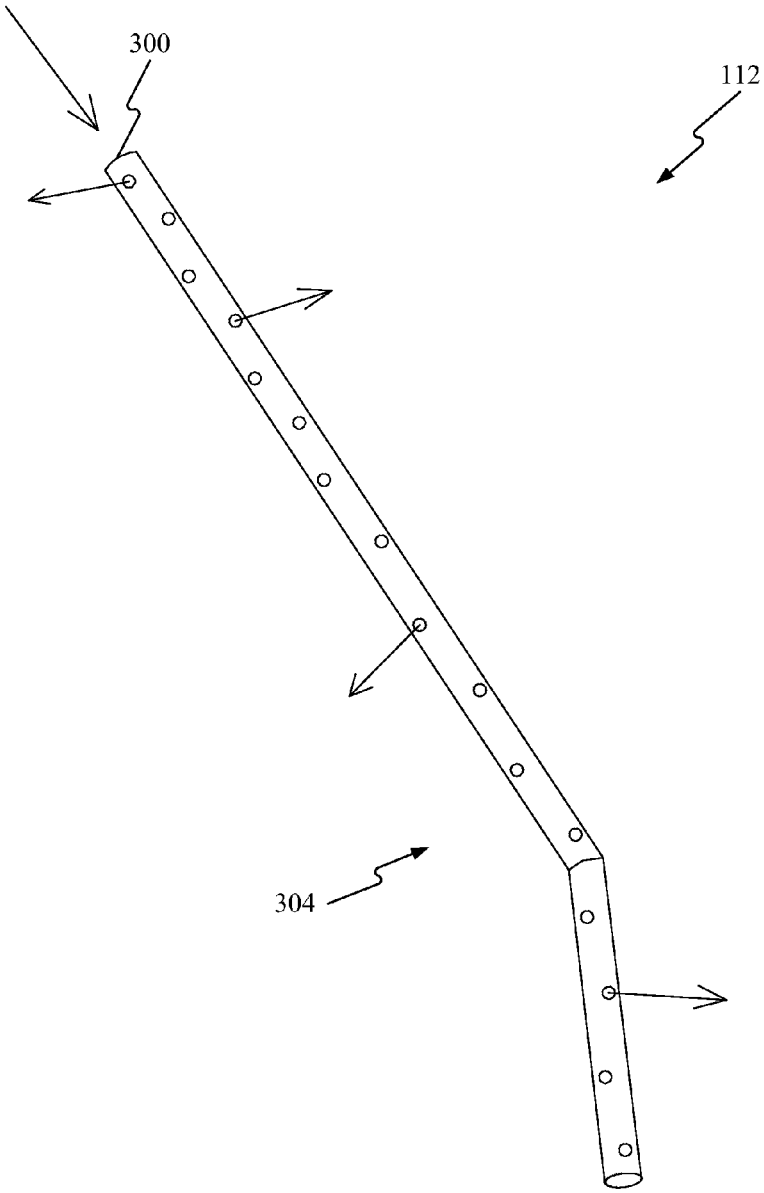
FIG. 3B shows a conduit which may be utilized in the hair dryer attachment, in accordance with an alternative embodiment.

As shown in FIGS. 3A and 3B, a conduit 112 may be flexible so that they may be positioned at various angles for directing heated air from the hair dryer 102 (see FIG. 1) toward a person's hair. In accordance with an embodiment, the conduit 112 may include an inlet 300 and an exit 302 (FIG. 3A). In accordance with an alternative embodiment, a conduit 112 may include the inlet 300 and multiple exits 304 dispersed throughout one or more sidewalls of the conduit 112 (FIG. 3B). It should be understood that in this embodiment, the end of the conduit 112 (i.e., the location of the exit 302 in the end portion of the conduit 112 shown in FIG. 3B) is closed so that heated air is prevented from passing through. Instead, as described above, the heated air in the conduit 112 of FIG. 3B is directed through the multiple exits 304 dispersed throughout one or more of the conduit 112 sidewalls. In accordance with yet another alternative embodiment, the conduit 112 may include the exit 302 located in an end portion as well as the multiple exits 304. It should be appreciated that in accordance with various embodiments, the attachment 104 may be configured so that all of the conduits 112 are configured as shown in FIG. 3A or all of the conduits 112 are configured as shown in FIG. 3B. In addition, the attachment 104 may include a mixture of the conduits 112 in FIGS. 3A and 3B such that some of the conduits 112 include the exit 302 and the remaining conduits 112 include the multiple exits 304. In addition, the attachment 104 may include a combination of the conduits 112 such that some of the conduits 112 include the exit 302, some of the conduits 112 include the multiple exits 304, and the remaining conduits 112 include both the exit 302 and the multiple exits 304. It should be further understood that the inlet 300 of the conduit 112 in FIGS. 3A and 3B may be in fluid communication with at least one of the plurality of passages 204 in the attachment 104.

In accordance with an embodiment, the conduits 112 described above with respect to FIGS. 1, 2, 3A and 3B may be constructed of an insulating material such as a polymer. Illustrative and non-limiting examples of polymers that may be employed in the conduits disclosed herein include a polyolefin, a chlorinated polyolefin, a chlorosulfonated polyolefin, a polychloroprene, a thermoplastic vulcanizate, an ethylene vinyl acetate, a polyamide, a polyvinyl chloride, polystyrene, and polyethylene, and the like, as well as any mixture or combination thereof. The insulating nature of the conduits 112 may prevent them from storing heat that may cause burns to a person's scalp or hair. It should be understood however, that the composition of the conduits 112 are not limited solely to polymer-based insulating materials and that other insulating materials, known to those skilled in the art, may also be utilized without departing from the spirit and scope of the various embodiments described herein.

It should be understood that the conduits 112 need not be all the same size. For example, the conduits 112 may be constructed to have varying diameters as well as varying lengths. For example, as shown in FIG. 2, a first subset of shorter conduits 112 may be positioned in the front of the attachment 104 for reaching and drying shorter hair near the top of a person's head while a second subset of longer conduits 112 may be positioned in the back of the attachment 104 for reaching and drying longer hair located near the back of a person's head.

It should be understood that the flexible nature of the conduits 112 may allow them to be bent at various angles for insertion into a person's hair. In particular, to assist in the accelerated drying of a person's hair a uniform fashion, the conduits 112 may be placed between various strands of hair on a person's head. In this manner the conduits 112 may allow warmed air to circulate between strands of hair as opposed to just at the surface layer of hair. While air may be circulated between strands of hair, a portion of the warmed air may also circulate between the interior surface of attachment 104 and the surface layer of hair. It should further be understood that the housing 202 may include various connectors (e.g., tabs, threads, prongs, etc.) that may be used to attach the attachment 104 to the hood 106. For example, as shown in FIG. 2A, the housing 202 may include the "threaded" rim 205. In this configuration, and in combination with a compatible hair dryer hood, the attachment may be easily screwed into the hood 106 for use prior to hair drying. In accordance with another embodiment, as shown in FIG. 2B, the housing 202 may include the rim 207 which, having a slightly smaller diameter than the diameter of the hood 106, enables the housing 202 to snap into the hood 106 of the hair dryer 102. It should further be understood that the housing 202 of the attachment 104 may be constructed in a number of different sizes so as to fit other hair dryer types (such as handheld hair dryers) or to better fit different head sizes.

It should be understood that the flexible nature of the conduits 112 may also allow for user comfort. Because the conduits 112 are able to bend, the user may be able to move his or her head during hair drying without poking the scalp. In addition, the flexible nature of the conduits 112 may allow the user to move his or her head without the conduits 112 being pulled from his or her hair thereby reducing the effectiveness of the conduits 112 in directing heat from the hair dryer 102.

It should be understood that the differing construction of the conduits 112 may allow for differing heat settings to be used. For example, conduits with a larger diameter and/or multiple exits may allow for better circulation of heated air. The better circulation may allow a lower heat setting to be used. The lower heat setting may conserve energy and may help minimize damage to hair. Furthermore, a lower heat setting may help prevent inadvertently causing heat to build up adjacent to a person's scalp and/or within the conduits 112 during hair drying, thereby preventing the burning of hair.

The use of conduits 112 to dry hair may offer significant time savings. For example, Table 1 shows some average times for drying different types of hair (i.e., natural hair, sew-in (weaved) hair and "roller set" hair).

TABLE 1

| Hair Type/ Style | Drying Time Without Conduits | Drying Time With Conduits | Difference |
|---|---|---|---|
| Natural Hair | 180 minutes | 45 minutes | 135 minutes |
| Sew In | 150 minutes | 45 minutes | 105 minutes |
| Roller Set | 60 minutes | 25 minutes | 35 minutes |

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or multiple items, just as reference to multiple items may mean a single item. Moreover, use of the term "and" when incorporated into a list is intended to imply that all the elements of the list, a single item of the list, or any combination of items in the list has been contemplated.

One skilled in the relevant art may recognize, however, that the invention may be practiced without one or more of the specific details, or with other methods, resources, materials, etc. In other instances, well known structures, resources, or operations have not been shown or described in detail merely to avoid obscuring aspects of the invention.

While example embodiments and applications of the present invention have been illustrated and described, it is to be understood that the invention is not limited to the precise configuration and resources described above. Various modifications, changes, and variations apparent to those skilled in the art may be made in the arrangement, operation, and details of the methods and systems of the present invention disclosed herein without departing from the scope of the claimed invention.

The above specification, examples, and data provide a description of the manufacture, operation and use of the invention. Since many embodiments of the invention can be made without departing from the spirit and scope of the invention, the invention resides in the claims hereinafter appended.

We claim:

1. An apparatus for accelerating hair drying time, comprising:

a housing comprising an interior surface and an exterior surface, the interior surface defining an interior volume having a size sufficient to cover a substantial portion of a person's head, the interior surface and the exterior surface defining a plurality of passages, the plurality of passages being positioned at least over a top of the person's head, wherein the housing further comprises a rim, wherein the rim of the housing is configured for attachment to a hair dryer comprising a hood such that a substantial portion of the housing is seated inside of the hood, the plurality of passages in fluid communication with the hood; and a plurality of flexible conduits, each of the plurality of flexible conduits consisting solely of a single piece of insulating material comprising an inlet, an exit, having one sidewall and an end portion, the inlet of at least one of each of the plurality of flexible conduits in fluid communication with at least one of the plurality of passages, wherein the exit of a first set of the plurality of flexible conduits comprises a combination of openings dispersed throughout the having one sidewall and an opening located in an end portion, wherein the exit of a second set of the plurality of flexible conduits comprises only openings dispersed throughout the having one sidewall, where the exit of a third set of the plurality of conduits comprises only an opening located in the end portion;

wherein at least one of the plurality of flexible conduits comprises a diameter which is larger than a diameter of each of the remaining plurality of flexible conduits for improving circulation of heated air and which allows for a lower heat setting to be utilized by the hair dryer;

wherein each of the plurality of flexible conduits may be placed between various strands of a person's hair to accelerate hair drying time such that the drying time when utilizing the plurality of flexible conduits is decreased by about thirty-five minutes for roller set hair with respect to a drying time for the roller set hair utilizing a hair dryer which does not utilized the plurality of flexible conduits, wherein the drying time when utilizing the plurality of flexible conduits is decreased by about one hundred five minutes for sew-in hair with respect to a drying time for the sew-in hair utilizing a hair dryer which does not utilize the plurality of flexible conduits, wherein the drying time when utilizing the plurality of flexible conduits is decreased by about one hundred thirty-five minutes for natural hair with respect to a drying time for the natural hair utilizing the hair dryer which does not utilize the plurality of flexible conduits.

2. The apparatus of claim 1, wherein the rim comprises at least one tab configured to engage the hood.

3. A hair dryer attachment, comprising:

a housing defining:

an interior volume having a size sufficient to cover a substantial portion of a person's head;

a plurality of passages, the plurality of passages being positioned at least over a top of the person's head; and a rim, wherein the rim of the housing is configured for attachment to a hair dryer comprising a hood such that a substantial portion of the housing is seated inside of the hood, the plurality of passages in fluid communication with the hood; and a plurality of flexible conduits, each of the plurality of flexible conduits consisting solely of a single piece of insulating material comprising an inlet, an exit, having one sidewall and an end portion, the inlet of each of the plurality of flexible conduits in fluid communication with at least one of the plurality of passages, wherein the exit of a first set of the plurality of flexible conduits comprises a combination of openings dispersed throughout the having one sidewall and an opening located in an end portion, wherein the exit of a second set of the plurality of flexible conduits comprises only openings dispersed throughout the having one sidewall, wherein the exit of a third set of the plurality of flexible conduits comprises only an opening located in the end portion;

wherein at least one of the plurality of flexible conduits comprises a diameter which is larger than a diameter of each of the remaining plurality of flexible conduits for improving circulation of heated air and which allows for a lower heat setting to be utilized by the hair dryer;

wherein each of the plurality of flexible conduits may be placed between various strands of a person's hair to accelerate hair drying time such that the drying time when utilizing the plurality of flexible conduits is decreased by about thirty-five minutes for roller set hair with respect to a drying time for the roller set hair utilizing a hair dryer which does not utilize the plurality of flexible conduits, wherein the drying time utilizing the plurality of flexible conduits is decreased by about one hundred five minutes for sew-in hair with respect to a drying time for the sew-in hair utilizing a hair dryer which does not utilize the plurality of flexible conduits, wherein the drying time when utilizing the plurality of flexible conduits is decreased by about one hundred thirty-five minutes for natural hair with respect to a drying time for the natural hair utilizing the air dryer which does not utilize the plurality of flexible conduits.

4. A hair dryer attachment, comprising:

a housing comprising an interior surface and an exterior surface, the interior surface defining an interior volume having a size sufficient to cover a substantial portion of a person's head, the interior surface and the exterior surface defining a plurality of passages, the plurality of passages being positioned over at least over a top of the person's head, wherein the housing further comprises a rim, the rim being configured for attachment to a salon hair dryer comprising a hood such that a substantial portion of the housing is seated inside of the hood, the hood being in fluid communication with the plurality of passages; and a plurality of flexible conduits, each of the plurality of flexible conduits consisting solely of a single piece of insulating material comprising an inlet, an exit, having one sidewall and an end portion, the inlet of at least one of each of the plurality of flexible conduits is in fluid communication with at least one of the plurality of passages, wherein the exit of a first set of the plurality of flexible conduits comprises a combination of openings dispersed throughout the having one sidewall and an opening located in an end portion, wherein the exit of a second set of the plurality of conduits comprises only openings dispersed throughout the having one sidewall, wherein the exit of a third plurality of flexible conduits comprises only an opening located in the end portion;

wherein at least one of the plurality of flexible conduits comprises a diameter which is larger than a diameter of each of the remaining plurality of flexible conduits for improving circulation of heated air and which allows for a lower heat setting to be utilized by the hair dryer;

wherein each of the plurality of flexible conduits may be placed between various strands of a person's hair to accelerate hair drying time such that the drying time when utilizing the plurality of flexible conduits is decreased by about thirty-five minutes for roller set hair with respect to a drying time for the roller set hair utilizing a hair dryer which does not utilize the plurality of flexible conduits, wherein the drying time utilizing the plurality of flexible conduits is decreased by about one hundred five minutes for sew-in hair with respect to a drying time for the sew-in hair utilizing a hair dryer which does not utilize the plurality of flexible conduits, wherein the drying time when utilizing the plurality of flexible conduits is decreased by about one hundred thirty-five minutes for natural hair with respect to a drying time for the natural hair utilizing the air dryer which does not utilize the plurality of flexible conduits.

* * * * *